US008667691B2

(12) United States Patent
Gibbs

(10) Patent No.: US 8,667,691 B2
(45) Date of Patent: Mar. 11, 2014

(54) ACTUATED NAIL CLIPPER

(76) Inventor: Terry L Gibbs, Oshkosh, WI (US)

( * ) Notice: Subject to any disclaimer, the term of this patent is extended or adjusted under 35 U.S.C. 154(b) by 307 days.

(21) Appl. No.: 13/175,642

(22) Filed: Jul. 1, 2011

(65) Prior Publication Data

US 2013/0000125 A1 Jan. 3, 2013

(51) Int. Cl.
*A45D 29/02* (2006.01)

(52) U.S. Cl.
USPC ..... 30/28; 132/75.5; 132/73.5

(58) Field of Classification Search
USPC ..... 30/26–29, 133, 341; 132/73.5, 75.5
See application file for complete search history.

(56) References Cited

U.S. PATENT DOCUMENTS 1,479,302 A * 1/1924 Jones ..... 30/200
1,819,616 A * 8/1931 Morin ..... 312/351.3
5,123,430 A * 6/1992 Davidovitz ..... 132/75.8
5,775,340 A * 7/1998 Rains ..... 132/73.5
6,138,360 A * 10/2000 Owens et al. ..... 30/28
6,325,069 B1 * 12/2001 Heims ..... 132/73
6,751,866 B2 * 6/2004 Yusufov et al. ..... 30/28
6,865,812 B1 * 3/2005 Martin, Jr. ..... 30/27
7,131,448 B2 * 11/2006 Lund et al. ..... 132/73.5
8,061,365 B2 * 11/2011 Rehkemper et al. ..... 132/73.6
2007/0089301 A1 * 4/2007 Arias et al. ..... 30/277.4
2009/0156307 A1 * 6/2009 Aguirre et al. ..... 463/38
2010/0107989 A1 * 5/2010 Manheimer et al. ..... 119/600
2012/0204891 A1 * 8/2012 McCourtney ..... 132/73.5

* cited by examiner

*Primary Examiner* — Boyer D Ashley
*Assistant Examiner* — Fernando Ayala

(57) ABSTRACT

The actuated nail clipper is a grooming tool that has made it easier to clip nails. The present invention can change in length so the toe nails are easily reachable for the consumer. The elongated neck prevents the consumer from feeling any discomfort that is normally associated with clipping toe nails. A vacuum on the actuated nail clipper can suction in leftover nail clippings. The convenience of the vacuum allows for easier clean up. The present invention also includes a small light that is angled so the nail that is being cut is clearly visible to the consumer. The light helps reduce errors in nail clipping as well as decrease the strain on the consumer's eyes.

9 Claims, 9 Drawing Sheets

ACTUATED NAIL CLIPPER

FIELD OF THE INVENTION

The present invention relates generally to a battery operated, self-actuating nail clipper. It is the objective of the present invention to provide people, especially those with injuries or disabilities, a way to clip toe nails without strain and a way to clean nail clippings conveniently. The present invention also provides a way for the nail clippings to be cleaned in an easier manner than present conventions.

BACKGROUND OF THE INVENTION

Personal grooming is something that applies to everyone, young or old, able or disabled. However, some personal grooming tasks are sometimes more difficult for some rather than others. One of these common personal grooming tasks is toe-nail clipping. A traditional nail clipper is quite small and fits in the palm of a hand. While they are quite convenient to clip finger nails, they are cumbersome to use for toenails. Usually, when attempting to clip toenails, an individual has to maneuver his body in rather unusual positions. These positions range from hunching over one's legs while sitting or even lifting one's foot on a table surface so the toe nails are reachable. Either position can be strenuous for the body to be in for extended amount of time. Keeping the body in these strained positions for very long can lead to multiple injuries. The present invention eliminates the need for bending over and remaining in a strained position. Additionally, the present invention allows a way for the nail clippings to be easily vacuumed and cleaned up. Nail clippings can be difficult to search for and dispose of. It is also a rather lengthy task. The Actuated Nail Clipper creates a way to discard nail clippings promptly and easily. Also, the present invention allows the individual user to view the nails easily because of its implemented LED light. The Actuated Nail Clipper is a convenient fix to the problems that arise from using traditional nail clippers on toenails.

DETAIL DESCRIPTIONS OF THE INVENTION

Figure 1:
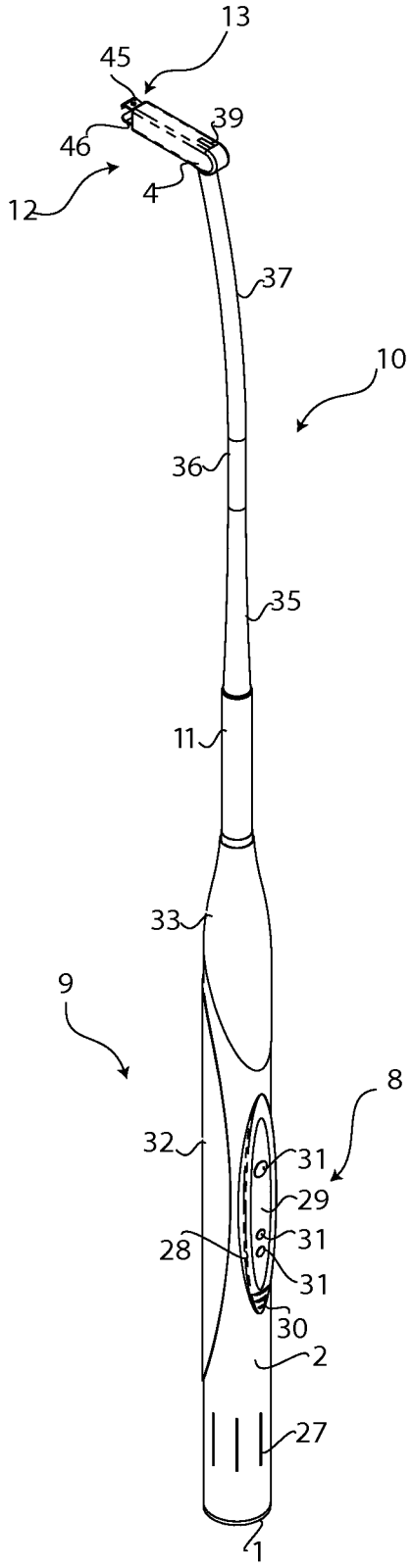
FIG. 1 is a perspective view of an actuated nail clipper.

All illustrations of the drawings are for the purpose of describing selected versions of the present invention and are not intended to limit the scope of the present invention.

In reference to FIG. 1, FIG. 5, FIG. 6, FIG. 8, FIG. 9, FIG. 10, FIG. 11, FIG. 12, FIG. 13, and FIG. 16, and FIG. 17, the Actuated Nail Clipper comprises of four major components, which include an end cap 1, a body 2, a neck 3, a head 4. These components can also be broken down further into smaller systems and sub systems. For example, the body 2 has five major systems. The five systems include a motor assembly 5, an actuating system 6, a vacuum system 7, a control panel system 8, and a plurality of soft grips 9. The neck 3 has two main components, which include a telescopic neck assembly 10 and an exterior segment 11. The last assembly, the head 4, can be separated into a head plate assembly 12, a clipper system 13, and an LED light 14. The Actuated Nail Clipper also includes a rechargeable dock station that helps not only to hold the present invention, but also helps it retain its power.

Once again, in reference to FIG. 1, FIG. 2, FIG. 6, FIG. 8, FIG. 9, FIG. 10, FIG. 12, and FIG. 13, the body 2, which is secured by the end cap 1, is important to the Actuated Nail Clipper's function because it contains the majority of the systems involved in making the Actuated Nail Clipper operate successfully. One constant problem of all nail clippers is the lack of control concerning nail clippings. More often than not, the nail clippings fly away, landing in unusual or hard to reach places. As a result, cleaning the clippings is a difficult task because they become either hard to find or difficult to pick up when they are found. Also, nails clippings are very light in color, making it difficult to be visible on a surface that is lighter or of the same coloring. This problem is even more prevalent in hospitals and nursing homes where residents are usually elderly, handicapped, or ill and cannot clip their nails themselves. In cases like these, nurses come and cut the patient's nails on their behalf. It usually occurs on the patient's bed because they cannot be transported anywhere else. Not all nail clippings can always be found and cleaned up quickly. Nurses have many tasks to accomplish throughout the day and as a result need to be able to finish one task in an efficient manner before moving on to the next. Cleaning up nail clippings with hands is not an efficient method of cleaning because of the time needed to search for the clippings. This is especially true for nurses in hospitals or nursing homes. It is important to prevent the patient from feeling any discomfort and disturbance. Quickly cleaning the nail trimmings equates to less disturbance for a patient. The Actuated Nail Clipper's vacuum system 7 is the solution to a quick clean up of unruly nail clippings. The vacuum system 7 is a suction tool that uses a vacuum tube 25 to pick up the uncontrollable clippings and store them in a nail container 26. The vacuum tube 25, which is embedded within the neck 3, is nearly as long as the entire Actuated Nail Clipper, ending at the nail container 26 located at the bottom of the present invention and reaching the head 4. The clippings are not in danger of falling out of the nail container 26 because the nail container 26 is secured by the end cap 1. The ventilation cuts 27 are narrow cuts that traverse through the exterior surface of the nail container 26. These ventilation cuts 27 are positioned below the vacuum motor 21. Since the vacuum motor 21, battery 20, and the actuator motor 16 will constantly run until the basic functions are turned off, there can be a lot of heat generated. If the heat is not expelled properly, the present invention can overheat and become dysfunctional. Consequently, the nail container 26 can be emptied whenever it is convenient for the consumer to do so. The vacuum system 7 helps to clean nail clippings quickly and efficiently because there is no need to meticulously search for nail clippings. To keep all the components inside of the body 2 intact, the end cap 1 can screw onto the end of the body, creating a secure fit. A base of the body 2, including the end cap 1, can rest inside a dock when the Actuated Nail Clipper is not in use. Since the vacuum system 7 needs to create a suction force to be able to pull in all the nail clippings, a fan 48 is needed to create sufficient air flow. The Actuated Nail Clipper uses a vacuum motor 21 in conjunction with a vacuum fan 48 and a battery 20. This vacuum motor 21, with its attached vacuum fan 48, will be able to generate air that flows through the vacuum tube 25 and up to the head 4. As a result, the vacuum tube 25 can be used on any area that needs to be cleaned. Also, nail clippings are often times very small and can get stuck in various cracks or crevices. The Actuated Nail Clipper is useful because of its ability to use its vacuum system 7 in small cracks and crevices, which allows cleaning up to be a much easier task. Another advantage to the vacuum system 7, is that it also provides for a more sanitary clean up since nails are often times dirty or fungus-ridden. With the vacuum, the nail clippings can be gathered and disposed of without anyone having to come into contact with it. The vacuum motor 21 is a part of the motor assembly 5. The motor assembly 5 is the component of the Actuated Nail Clipper that controls most of its functions. It contains, aside from the vacuum motor 21, an actuator motor 16, a plurality of cavities (top 15, bottom 17, and middle 18) and a connector arm 19. The vacuum motor 21, as mentioned earlier, is used to create a suction force inside the vacuum tube 21 with its fan. Since the vacuum motor 21 can be easily damaged, it is housed inside of the bottom cavity 18. Consequently, the bottom cavity 18 protects the vacuum motor 21 from any excessive damage that could have been caused by leaving the vacuum motor 21 open inside of the body 2. The bottom cavity 18 then uses a connector arm 19 to attach to the battery 20, which is used to power both the vacuum 21 and actuator motor 16. The battery 20, like the vacuum motor 21, is encased within a cavity 17, which serves as a protector to the battery 20, preventing it from any possible damage. The next component in the motor assembly 5 is the actuator motor 16. The actuator motor 16 is connected to the battery 20 with a connector arm 19, which therefore allows the battery 20 to power the actuator motor 16. One of the benefits of the Actuated Nail Clipper is to clip nails without the need of using force exerted from hands. It uses an actuator 22 to create the movement of clipping. The actuating system 6 includes three components that work in unison with the actuator motor 16. These components include a helical gear shaft 23, a nut 24, and a clipping actuator 22. The actuator motor 16 is a fan-less motor that is connected to the helical gear shaft 23. The clipping actuator 22 is placed partially inside of the helical gear shaft 23, while the rest of the clipping actuator 22 extends far beyond the helical gear shaft 23. The movement of the clipping actuator 22 is controlled by the actuator motor 16. Since the clipping actuator 22 is a lever that needs to reach the head 4 so the actuator motor 16 can work to control the movement of the clipping system 13, it spans from inside the helical gear shaft 23 to the head 4. To prevent any slipping of the clipping actuator 22 from the inside of the helical gear shaft 23, the connection is secured with a nut 24. The clipping actuator 22 exerts a force on the clipper system 13 similar to how hands operate a traditional nail clipper. Another important aspect of the body 2 in the Actuated Nail Clipper is the control panel system 8. The control panel system 8 initiates both the vacuum 7 and actuating system 6. The convenience of the Actuated Nail Clipper is that it is operated with button controls 31, not force or pressure from fingers. The control panel system 8 includes a control panel platform 28, a control panel 29, a control panel grip 30, and a plurality of buttons 31. The control panel system 8 is where the switches for powering on and off various features of the Actuated Nail Clipper are available. The control panel system 8 begins with the control panel platform 28, which is a protruded piece of material where the control panel 29 is placed. The control panel 29, which contains buttons 31 that control various functions of the Actuated Nail Clipper, is the main user interface. Since the control panel 29 will be operated using fingers, it is important that it is also comfortable to handle. The control panel grip 30, which is located at the base of the control panel 29, is a set of small protrusions that acts as a traction surface so the user's hand does not slip off the control panel 29. It is important to ensure that the present invention does not fall out of someone's hands when in use. Another added feature on the Actuated Nail Clipper that can assist with grasping onto the present invention is the set of soft grips 9 along the exterior of the body. The soft grips 9 help to add more friction on the surface to prevent slipping. These grip features make the Actuated Nail Clipper comfortable to use, for anyone. There are two separate soft grips 9, a finger grip 32 for where the fingers will rest on the present invention and a thumb grip 33 where the thumb will rest on the body 2 of Actuator Nail Cutter. Comfort is added to the Actuated Nail Clipper because of its shape. Since the Actuated Nail Clipper must be handheld during its use, it is important to be sure that the present invention is designed to fit the contours of the user's hand, which will make the present invention more comfortable to use. Also, the traditional nail clipper requires force from an index finger and a thumb. Requiring only two fingers can lead to injuries because the force needed to clip nails is not evenly distributed throughout the entire hand. The common nail clipper uses a thumb and an index finger to press a bottom and top clipper together. The original method can lead to placing too much pressure on the two fingers that are important to the functionality of hands. The Actuated Nail Clipper's buttons 31, are a quick solution to preventing any finger injuries that could result from using a traditional nail clipper. The purpose of the Actuated Nail Clipper is to make nail clipping a more comfortable and easy experience.

Figure 2:
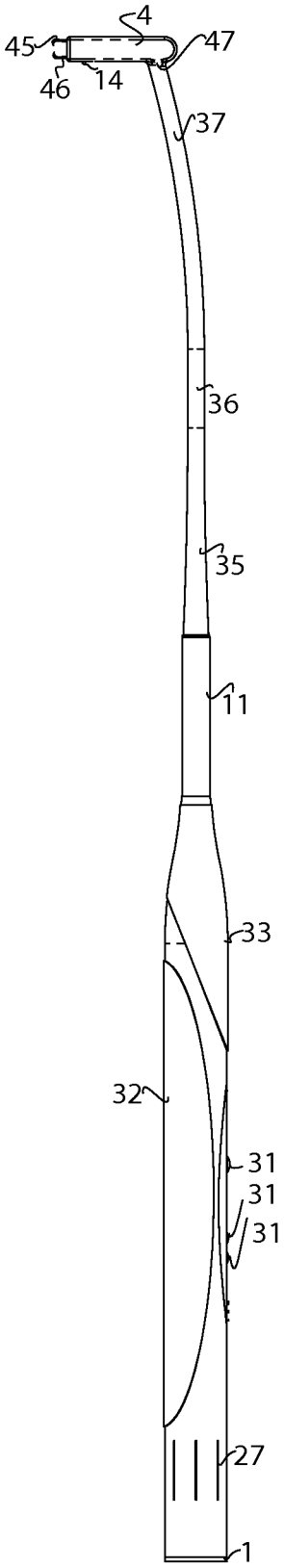
FIG. 2 is a front elevational view thereof.
Figure 3:
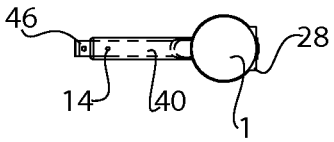
FIG. 3 is a bottom plan view thereof.
Figure 4:
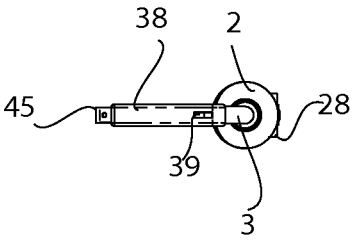
FIG. 4 is a top plan view thereof.
Figure 5:
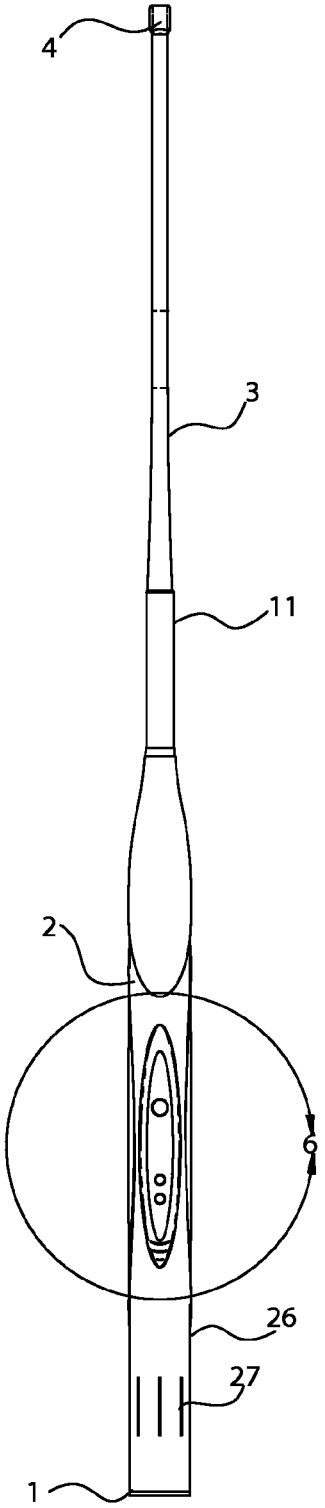
FIG. 5 is a front elevational view showing the area upon which a close-up view is taken and shown in FIG. 9.
Figure 6:
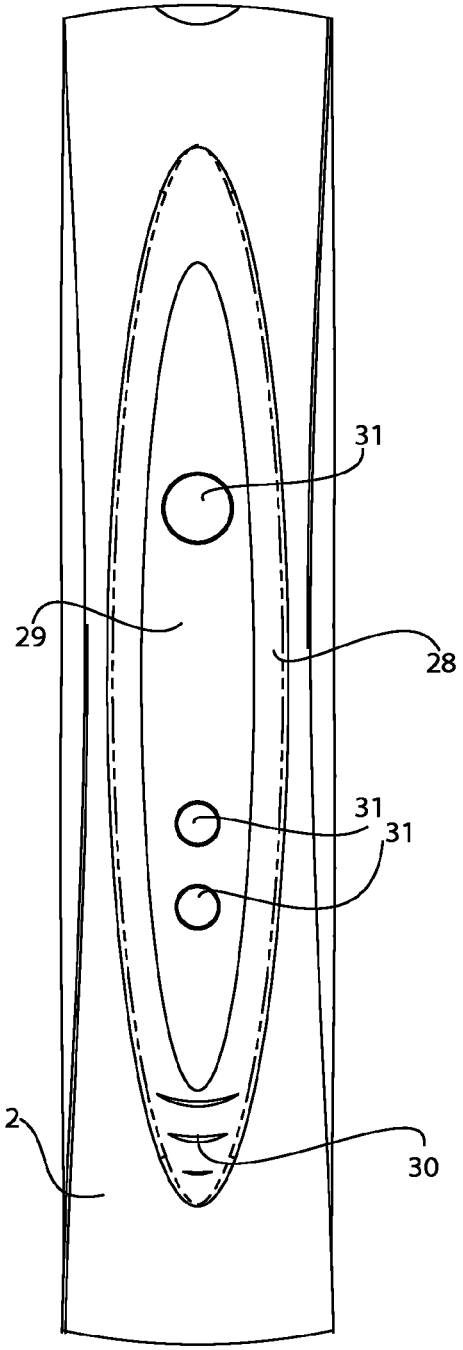
FIG. 6 is a close up view thereof showing the buttons.
Figure 7:
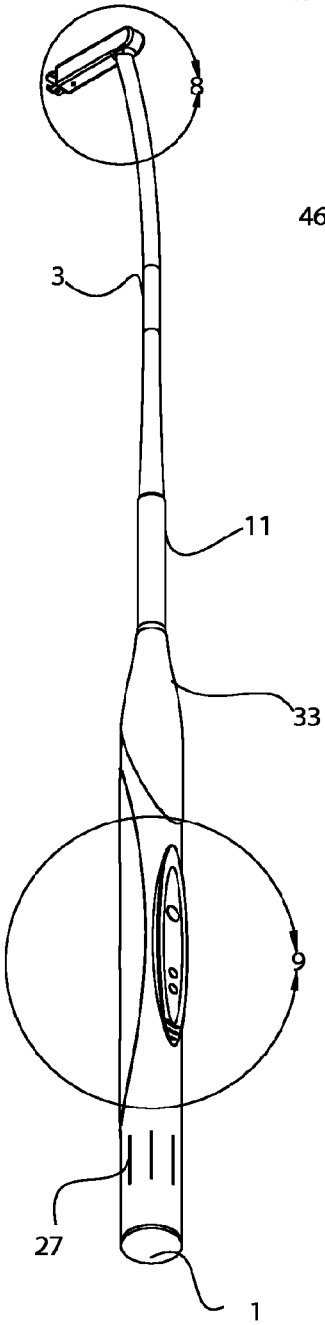
FIG. 7 is a bottom perspective view showing the area upon a close-up is taken and shown in FIG. 8 and FIG. 9.
Figure 8:
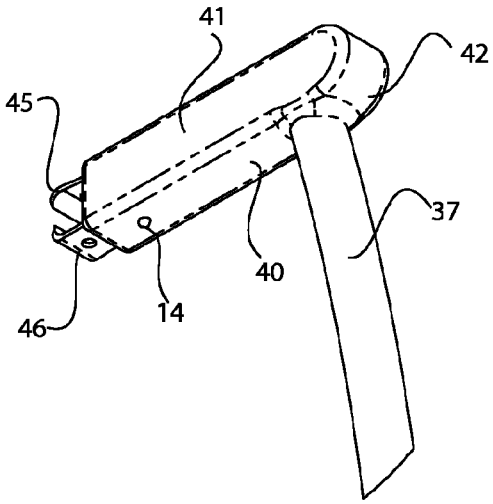
FIG. 8 is a close up view of the head of the actuated nail clipper showing a better view of the LED light.
Figure 9:
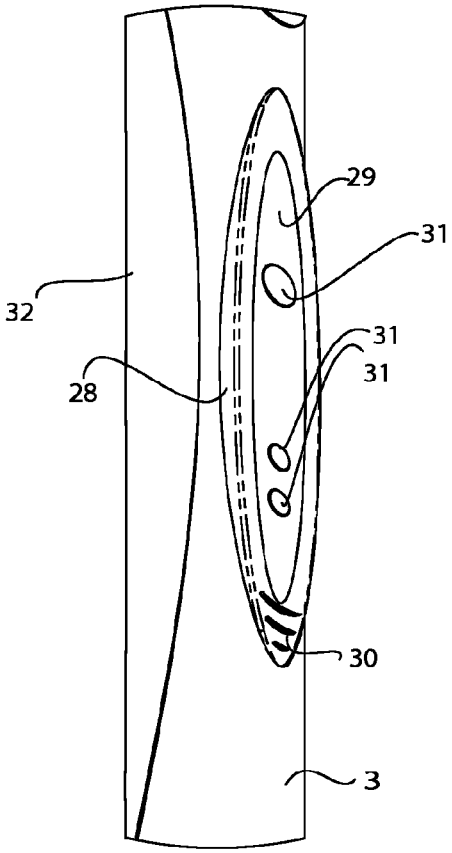
FIG. 9 is a close up view of the control panel on the body of the actuated nail clipper showing a better view of the buttons.
Figure 10:
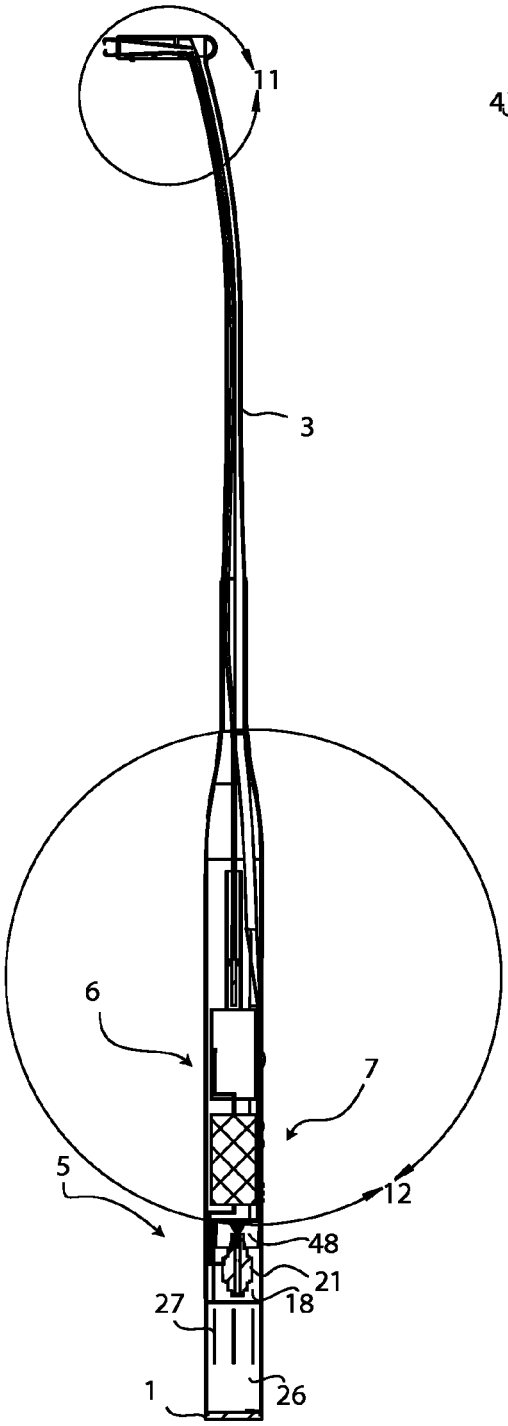
FIG. 10 is a sectional view of the actuated nail clipper as shown in FIG. 5 showing the area upon which a close-up is taken and shown in FIG. 11 and FIG. 12.
Figure 11:
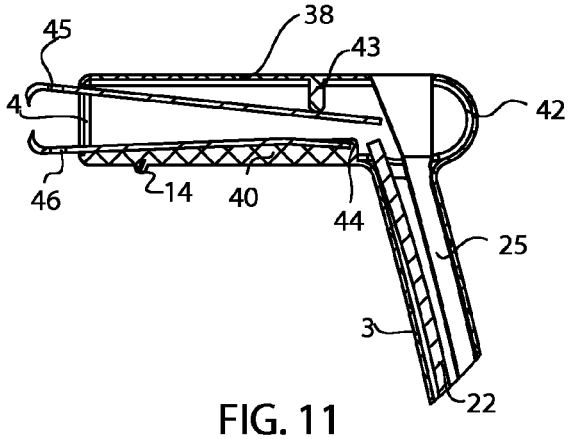
FIG. 11 is a detailed view of a section view on the head of the actuated nail clipper as shown in FIG. 10.
Figure 12:
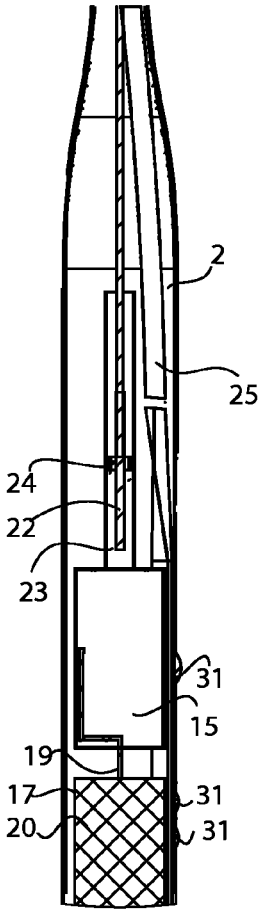
FIG. 12 is a detailed view of a section view of the body of the actuated nail clipper as shown in FIG. 10.
Figure 13:
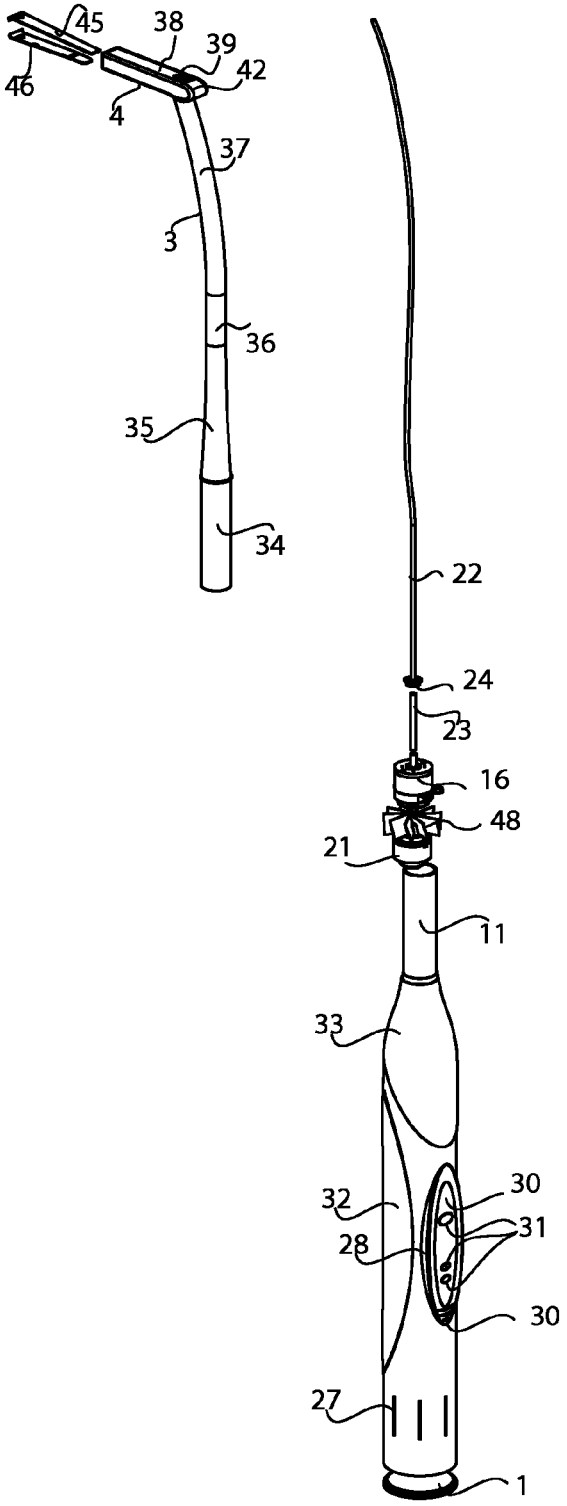
FIG. 13 is an exploded view of the entire actuated nail clipper assembly.

In reference to FIG. 1 FIG. 2, and FIG. 10, the next main assembly for the Actuated Nail Clipper is the neck 3. The neck 3 comprises of an exterior segment 11 and a telescopic neck assembly 10. An important feature of the Actuated Nail Clipper is the ability to extend to the toes without much effort from the user. The problem with bending over to clip toe nails is that it can lead to many different injuries. The more serious of the injuries include pulling a muscle or straining the spine. Since the spine is an important but sensitive bone in the body, its injury could further develop into more injuries. The Actuated Nail Clipper can reach the toes of a person easily because of its neck 3, and its subcomponents. The neck's 3 primary component is the telescopic neck assembly 10. The telescopic neck assembly 10 includes an interior segment 34, a tapered segment 35, a straight segment 36, and a curved segment 37. The interactions between the different subcomponents of the telescopic neck assembly 10 allow the consumer to extend the neck 3 past its initial length, if needed. A long neck is useful to people who are short or inflexible and cannot reach their toes easily. However, the Actuated Nail Clipper does not neglect the rest of the population. The telescopic neck has the ability to decrease in length. It can range from fourteen inches to sixteen inches. As a result, the Actuated Nail Clipper is a convenient for anyone. The telescopic neck 10 connects to the body 2 of the Actuated Nail Clipper, which ensures a more secure connection between the body 2 and the neck. The first part of the telescopic neck 10 is the interior segment 34, which is inserted into the exterior segment 11 of the neck 3. The connection of the interior 34 and exterior 11 segments ensures that the neck 3 is securely attached to the rest of the body 2. The next part of the telescopic neck 10 is the tapered segment 35, which is a contoured component. The tapered segment 35 is a small piece that is slightly larger at one end rather than the other. The smaller end connects to the interior segment 34. The tapered segment 35 is contoured in its shape so it can fit with the interior segment 34, which is slightly smaller than the other components of the telescopic neck 10 because it has to be inserted into the exterior segment 11. The other end of the tapered segment 35 is attached to the straight segment 36, which is used to add more length to the Actuated Nail Clipper. The length of the Actuated Nail Clipper is what enables the present invention to reach toe nails as needed. The straight segment 36 also prevents the neck 3 from being overly bent that the head 4 cannot even reach the toes properly because it acts as a support for the following segment. The length of the Actuator Nail Clipper ensures that a person can comfortably reach for their toes. Also, it is important to ensure that the clippers (top 45 and bottom 46) can actually reach each toe nail individually, as opposed to grabbing onto cuticles or any other side of the skin. The Actuated Nail Clipper is capable of accurately reaching the toe nail because of the slight shape of the curved segment 37. The curve is minimal enough that the Actuator Nail Clipper does not overreach for toe nails, or under reach. When clipping toe nails, it is important that the top 45 and bottom 46 clippers are used properly. The curved segment 37 mimics the shape of an arm and a wrist when conventionally clipping toe nails. When using a traditional nail clipper, the hand is bent and curved so that the clipper is in the right position to clip nails. The curved segment 37 is the largest segment within the neck segment assembly. While the curved segment 37 begins to extend straight from the straight segment 36, it becomes curved towards the end. All segments involved in the telescopic neck assembly 10 are hollow with an extra compartment in which the vacuum tube 25 can slide through. As a result, the telescopic neck assembly 10 and its subcomponents are able to maintain the shape of the vacuum tube 25. By doing so, the vacuum tube 25 can reach the head 4 at one end and the nail container 26 at the other end. The neck 3, with all of its components, can then merge with the head 4 of the Actuated Nail Clipper.

In reference to FIG. 1, FIG. 2, FIG. 3, FIG. 4, FIG. 8, FIG. 11, FIG. 12, and FIG. 13, the last main assembly for the Actuated Nail Clipper is the head 4. This assembly consists of small subsystems, which include a head plate assembly 12, a clipper system 13, and a LED light 14. The other main function of the Actuated Nail Clipper is that it will need to be able to do the same things as a traditional nail clipper. Therefore, it needs to have a top 45 and a bottom 46 clipper in place that can be used to cut any toe nails. The Actuated Nail Clipper also cuts the nails in the same way that a traditional nail clipper does, by pinching the nail with a sharpened edge of both the top 45 and bottom 46 clippers. The head plate assembly 12 creates the structure of the head 4, which is where all the other subsystems of the head 4 are placed. The head plate assembly 12 consists of a top plate 38, a bottom plate 40, a plurality of side plates 41, and a closing cap 42. The side plates 41 are parallel to each other and aligned rest on top of the bottom plate 40. The top plate 38 rests atop the side plates 41. The closing cap 42 then comes in and covers one end of the hollow rectangular shape that was created by the top 38, bottom 40, and side 41 plates. Since there needs to be an area for the neck to feed into the head, the bottom plate 40 is smaller than the top plate 38. The difference in size creates a gap 47 between the bottom plate 40 and the closing cap 42, which allows space for the neck 3 to be attached to the head 4. It also provides adequate space for the vacuum tube 25 and the clipping actuator 22 to reach the top plate 38 and the clipper system 13, respectively. An added convenience to the Actuated Nail Clipper is the ability to vacuum up nail clippings that are left over from clipping toe nails. The top plate 38 has a vacuum hole 39 that provides room for the vacuum tube 25 to have access to the nail clippings because an end of the vacuum tube 25 is attached to the vacuum hole 39. The next component in the head 4 of the Actuated Nail Clipper is the clipper system 13. Consisting of a top clipper 45, a bottom clipper 46, and a clipper barrier 43, the clipper system 13 is used in junction with the clipping actuator 22. The clipper system 13 is the part of the Actuated Nail Clipper that comes into contact with the toe nails. To be able to clip the actual nail off, the top clipper 45 and the bottom clipper 46 need to come into contact with one another with enough force that it causes the nail to break off. This is accomplished by the relationship between the clipper actuator 22, the clipper barrier 43, and the top clipper 45. The clipper barrier 43 is a protrusion that extends from the interior surface of the top plate 38. Its placement allows for it to control the movement of the top clipper 45, which is positioned underneath the top plate 38. The top clipper 45 needs to be able to come into contact with the clipper actuator 22, which is located near the closing cap 42. The clipper barrier 43, which extends directly perpendicular from the top plate 38, comes into contact with the top clipper 45 near the end of the top clipper's 45 top surface. This allows the clipper barrier 43 to push the top clipper 45 down at an angle, which enables the clipper actuator 22 to come into contact with an end of the top clipper 45. The clipper barrier 43 and clipper actuator 22 work simultaneously to control the movement of the top clipper 45. Unlike the top clipper 45, the bottom clipper 46 is kept predominately stationary. One end of the bottom clipper 45 is encased in a slot 44 that is located on the bottom plate 40. As a result, the bottom clipper 46 does not move freely and disrupt the clipping action. The lack of movement of the bottom clipper 46 allows the top clipper 45 to control the majority of the cutting. Another component of the head 4 is the LED light 14. Toe nail clipping can be difficult because the lack of light that is available to shine on the toe nail. Adequate lighting can create more precise and accurate clippings. The LED light 14 not only helps to create a better working space, it also helps the user obtain a better grasp of what he or she is doing because the area is well-lit. Also, the angle at which the LED light 14 is placed on the bottom plate 40 creates a way for the LED light 14 to shine on each specific nail that is being clipped at the time. The LED light 14 interacts with the way the head 4 is positioned when clipping nails, because LED light's 14 position is dependent on how the head 4 is maneuvered. The head 4 is positioned so the sharp edges of the top 45 and bottom 46 clippers can come into direct contact with the nail. This position ensures that the LED light 14 illuminates the nail that is being clipped.

Figure 16:
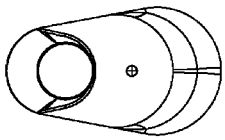
FIG. 16 is a top plan view thereof.
Figure 14:
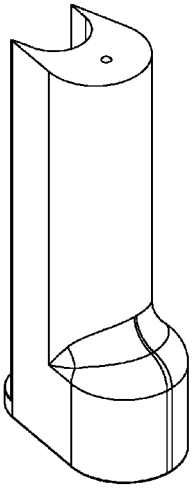
FIG. 14 is a perspective view of a dock.
Figure 15:
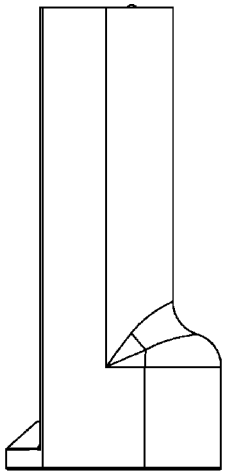
FIG. 15 is a front elevational view thereof.
Figure 17:
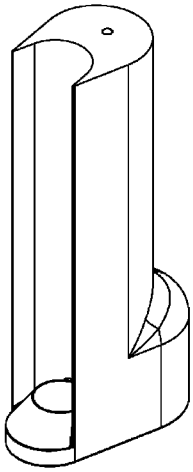
FIG. 17 is a projected view of the dock shown in FIG. 15.
Figure 18:
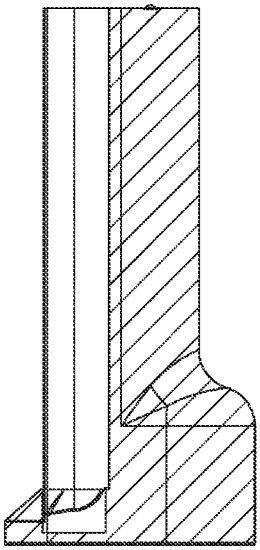
FIG. 18 is a left-side elevational view of the dock.
Figure 19:
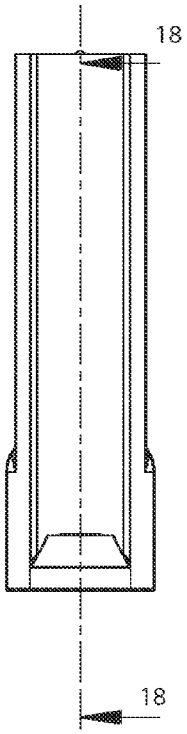
FIG. 19 is a sectional view of the dock as shown in FIG. 18.
Figure 20:
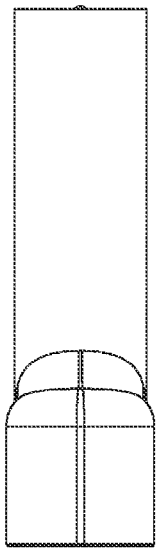
FIG. 20 is a right-side elevational view of the dock.

In reference to FIG. 15, FIG. 16, and FIG. 17, the dock comprises of a lofted platform, a plurality of side guards, and an indicator light. A benefit of the Actuated Nail Clipper is that it uses a rechargeable battery. To recharge the battery, the dock needs to be able to hold the Actuated Nail Clipper and convey to the consumer when the battery is finished charging.

With the lofted platform and the plurality side guards, the dock can hold the Actuated Nail Clipper upright. The bottom portion of the Actuated Nail Clipper fits through the lofted platform The indicator light on the dock illustrates if the battery has completed charging or not.

Although the invention has been explained in relation to its preferred embodiment, it is to be understood that many other possible modifications and variations can be made without departing from the spirit and scope of the invention as hereinafter claimed.

What is claimed is:

1. An actuated nail clipper comprises, a body;

a neck;

a head;

an end cap;

the head being positioned at the first tip of the neck;

the body being positioned at the second tip of the neck opposite to the head;

the end cap being positioned on the bottom surface of the body;

the body comprises of a motor assembly, an actuating system, a vacuum system, a control panel system, and a plurality of soft grips;

the neck comprises of a telescopic neck assembly and an exterior segment;

the head comprises of a head plate assembly, an LED light, and a clipper system;

the telescopic neck being positioned inside the exterior segment;

the head plate assembly being extended from the tip of the telescopic neck;

the clipper system being positioned inside of the head plate assembly;

the LED light being at a base of the head plate assembly;

the telescopic neck assembly comprises of an interior segment, a tapered segment, a straight segment, and a curved segment;

the head plate assembly comprises of a top plate, a bottom plate, a plurality of side plates, a gap, and a closing cap;

the clipper system comprises of a top clipper, a bottom clipper, and a clipper barrier;

the interior segment being positioned inside of the exterior segment;

the tapered segment being connected to the interior segment;

the straight segment being connected to the tapered segment;

the curved segment being connected to the straight segment;

the curved segment being connected to the bottom plate;

the top plate being positioned on the side plates;

the bottom plate being positioned on opposing surface of the side plates;

the closing cap being semi-circle shaped;

the closing cap being connected to the bottom plate, the plurality of side plates, and the top plate;

the gap being created between the bottom plate and the closing cap;

the vacuum tube being positioned inside the gap;

the clipper barrier being protruded from an inside surface of the top plate;

the top clipper being positioned under the top plate; and the bottom clipper being positioned atop the bottom plate.

2. The actuated nail clipper as claimed in claim 1 comprises, the top plate comprises of a vacuum hole;

the bottom plate comprises of a slot;

the vacuum hole being traversed through the top plate;

the vacuum hole being positioned directly above the vacuum tube;

the slot being positioned at a top surface of the bottom plate; and the bottom clipper being positioned inside the slot.

3. An actuated nail clipper comprises, a body;

a neck;

a head;

an end cap;

the head being positioned at the first tip of the neck;

the body being positioned at the second tip of the neck opposite to the head;

the end cap being positioned on the bottom surface of the body;

the body comprises of a motor assembly, an actuating system, a vacuum system, a control panel system, and a plurality of soft grips;

the neck comprises of a telescopic neck assembly and an exterior segment;

the head comprises of a head plate assembly, an LED light, and a clipper system;

the vacuum system being positioned at the base of the inside of the body;

the vacuum system being connected to the end cap;

the motor assembly being connected to the vacuum system;

the actuating system being connected to the motor assembly;

the control panel system being positioned on the outer surface of the body;

the plurality of soft grips being positioned on the outer surface of the body opposite to the control panel system;

the telescopic neck being positioned inside the exterior segment;

the head plate assembly being extended from the tip of the telescopic neck;

the clipper system being positioned inside of the head plate assembly;

the LED light being at a base of the head plate assembly;

the motor assembly comprises of a plurality of cavities, a battery, a plurality of connector arms, a vacuum motor, a fan, and an actuator motor;

the actuating system comprises of a clipping actuator, a helical gear shaft, and a nut;

the vacuum system comprises of a vacuum tube, a nail container, and a plurality of ventilation cuts;

the control panel system comprises of a control panel platform, a control panel, a control panel grip, and a plurality of buttons;

the plurality of soft grips comprises of a finger grip and a thumb grip;

the plurality of cavities comprises of a bottom cavity, a middle cavity, and a top cavity;

the bottom cavity being positioned near the bottom of the body;

the middle cavity being positioned above the bottom cavity;

the top cavity being positioned above the middle cavity;

the connector arm being traversed through the bottom cavity, the middle cavity, and the top cavity;

the fan being positioned on top of the vacuum motor;

the vacuum motor being positioned inside the bottom cavity;

the battery being positioned inside the middle cavity;

the actuator motor being positioned inside the top cavity;

the helical gear being connected to the top surface of the top cavity;
the helical gear being traversed through the nut;
the clipping actuator being a solid shaft with a curved tip;
the clipping actuator being positioned inside of the helical gear;
the vacuum tube being positioned behind the clipping actuator inside of the body;
the vacuum tube being extended to the head;
the vacuum tube being connected to the nail container;
the nail container being positioned inside of the body underneath the bottom cavity;
the plurality of buttons being positioned on the control panel;
the plurality of ventilation cuts being positioned on the nail container;
the end cap being positioned at the base of the nail container;
the control panel platform being positioned on the outer surface of the body;
the control panel being positioned on top of the control panel platform;
the control panel grip being protrusions at the bottom surface of the control panel;
the thumb grip being positioned on the front surface of the body; and
the finger grip being positioned on the back surface of the body.

4. The actuated nail clipper as claimed in claim 3 comprises,
the telescopic neck assembly comprises of an interior segment, a tapered segment, a straight segment, and a curved segment;
the head plate assembly comprises of a top plate, a bottom plate, a plurality of side plates, a gap, and a closing cap; and
the clipper system comprises of a top clipper, a bottom clipper, and a clipper barrier.

5. The actuated nail clipper as claimed in claim 4 comprises,
the interior segment being positioned inside of the exterior segment;
the tapered segment being connected to the interior segment;
the straight segment being connected to the tapered segment;
the curved segment being connected to the straight segment;
the curved segment being connected to the bottom plate;
the top plate being positioned on the side plates;
the bottom plate being positioned on opposing surface of the side plates;
the closing cap being semi-circle shaped;
the closing cap being connected to the bottom plate, the plurality of side plates, and the top plate;
the gap being created between the bottom plate and the closing cap;
the vacuum tube being positioned inside the gap;
the clipper barrier being protruded from an inside surface of the top plate;
the top clipper being positioned under the top plate; and
the bottom clipper being positioned atop the bottom plate.

6. The actuated nail clipper as claimed in claim 5 comprises,
the top plate comprises of a vacuum hole;
the bottom plate comprises of a slot;
the vacuum hole being traversed through the top plate;
the vacuum hole being positioned directly above the vacuum tube;
the slot being positioned at a top surface of the bottom plate; and
the bottom clipper being positioned inside the slot.

7. An actuated nail clipper comprises,
a body;
a neck;
a head;
an end cap;
the head being positioned at the first tip of the neck;
the body being positioned at the second tip of the neck opposite to the head;
the end cap being positioned on the bottom surface of the body;
the body comprises of a motor assembly, an actuating system, a vacuum system, a control panel system, and a plurality of soft grips;
the neck comprises of a telescopic neck assembly and an exterior segment;
the head comprises of a head plate assembly, an LED light, and a clipper system;
the vacuum system being positioned at the base of the inside of the body;
the vacuum system being connected to the end cap;
the motor assembly being connected to the vacuum system;
the actuating system being connected to the motor assembly;
the control panel system being positioned on the outer surface of the body;
the plurality of soft grips being positioned on the outer surface of the body opposite to the control panel system;
the telescopic neck being positioned inside the exterior segment;
the head plate assembly being extended from the tip of the telescopic neck;
the clipper system being positioned inside of the head plate assembly;
the LED light being at a base of the head plate assembly;
the motor assembly comprises of a plurality of cavities, a battery, a connector arm, a vacuum motor, a fan, and an actuator motor;
the actuating system comprises of a clipping actuator, a helical gear shaft, and a nut;
the vacuum system comprises of a vacuum tube, a nail container, and a plurality of ventilation cuts;
the telescopic neck assembly comprises of an interior segment, a tapered segment, a straight segment, and a curved segment;
the head plate assembly comprises of a top plate, a bottom plate, a plurality of side plates, a gap, and a closing cap;
the clipper system comprises of a top clipper, a bottom clipper, and a clipper barrier;
the interior segment being positioned inside of the exterior segment;
the tapered segment being connected to the interior segment;
the straight segment being connected to the tapered segment;
the curved segment being connected to the straight segment; and
the curved segment being connected to the bottom plate.

8. The actuated nail clipper as claimed in claim 4 comprises,
the top plate being positioned on the side plates;
the bottom plate being positioned on opposing surface of the side plates;

the closing cap being semi-circle shaped;

the closing cap being connected to the bottom plate, the plurality of side plates, and the top plate;

the gap being created between the bottom plate and the closing cap;

the vacuum tube being positioned inside the gap;

the clipper barrier being protruded from an inside surface of the top plate;

the top clipper being positioned under the top plate;

the bottom clipper being positioned atop the bottom plate;

the top plate comprises of a vacuum hole; and the bottom plate comprises of a slot.

9. The actuated nail clipper as claimed in claim 5 comprises, the vacuum hole being traversed through the top plate;

the vacuum hole being positioned directly above the vacuum tube;

the slot being positioned at a top surface of the bottom plate; and the bottom clipper being positioned inside the slot.

* * * * *